United States Patent [19]

Weinstein et al.

[11] Patent Number: 4,568,002

[45] Date of Patent: Feb. 4, 1986

[54] DISPENSING METHOD AND APPARATUS

[75] Inventors: Bernard Weinstein, Plainfield; William L. H. Hemsarth, High Bridge, both of N.J.

[73] Assignee: American Home Products Corporation (Del.), New York, N.Y.

[21] Appl. No.: 499,126

[22] Filed: May 31, 1983

[51] Int. Cl.[4] ..... B67D 5/64

[52] U.S. Cl. ..... 222/131; 222/168; 222/402.14; 384/107

[58] Field of Search ..... 222/129, 130, 131, 136, 222/167, 168, 160, 183, 402.1, 402.14, 548, 1; 239/251, 337; 384/107

[56] References Cited

U.S. PATENT DOCUMENTS

| | | | |
|---|---|---|---|
| 1,959,886 | 5/1934 | Wadsworth | 239/251 X |
| 2,742,342 | 4/1956 | Dew et al. | 21/53 |
| 3,352,364 | 11/1967 | De Coste | 239/251 X |
| 3,460,381 | 8/1969 | Boyle | 384/107 X |
| 3,710,984 | 1/1973 | Webster | 222/145 |
| 3,785,569 | 1/1974 | Helmrich | 239/337 |
| 4,171,340 | 10/1979 | Nishimura et al. | 422/36 |

FOREIGN PATENT DOCUMENTS

| | | | |
|---|---|---|---|
| 2314122 | 10/1973 | Fed. Rep. of Germany | 222/402.14 |

*Primary Examiner*—Joseph J. Rolla
*Assistant Examiner*—Michael S. Huppert
*Attorney, Agent, or Firm*—Arthur E. Wilfond

[57] ABSTRACT

A method and apparatus for the total dispensing of the contents, e.g. insecticide, of a container, which comprises actuating a release valve by an actuator and placing at least the actuator in rotation about a vertical axis as the contents discharge.

5 Claims, 16 Drawing Figures

FIG. 15
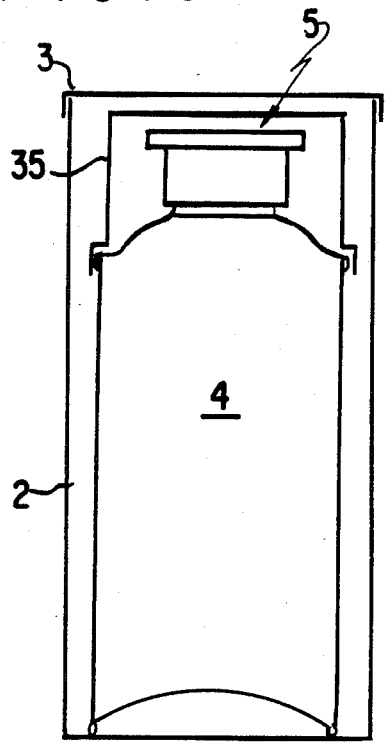
FIG. 16
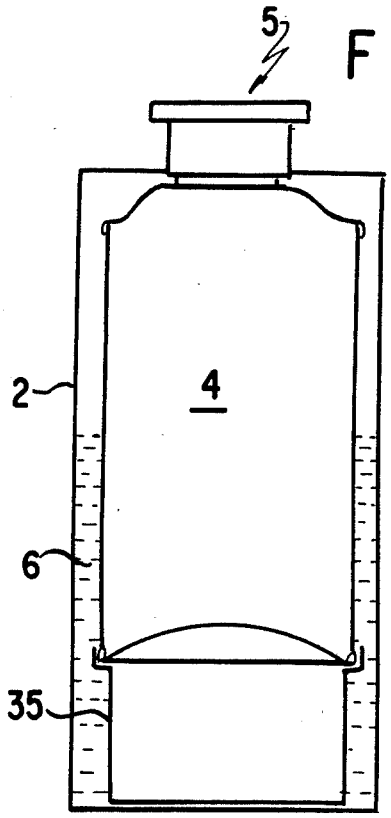
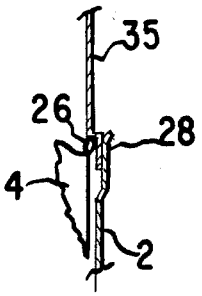
FIG. 13
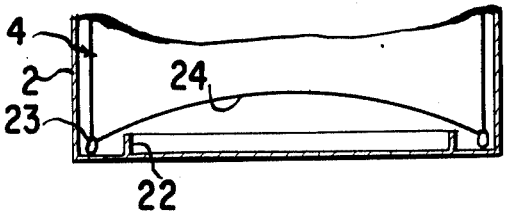
FIG. 14

DISPENSING METHOD AND APPARATUS

The instant invention relates to a method and apparatus for wide coverage dispensing of an aerosol.

There are many applications, such as insecticides, air fresheners, paints, oven cleaners, etc. wherein 360° coverage is desirable. There are at least three different total release indoor insecticide systems for the application of an aerosol insecticide. These devices all have in common, locking an activator in place to open a valve within the container so that the contents will automatically be released straight up from the top of the container. The user is instructed to hold the device at an arms length when releasing, place the container, which is now dispensing its contents as a fine fog, in an upright position and to leave the area at once. After the fog has been permitted to settle, one can return to the area and throw the fogger away. These devices have the disadvantage that the fog is sprayed upwardly into the atmosphere, with reduced lateral coverage. The lateral coverage, which does occur, is as a consequence of the mobility of the aerosol particles as they settle.

Other techniques and apparatus for the vaporization of sublimate solids are seen in the U.S. Pat. No. 2,742,342 of Dew et al and U.S. Pat. No. 4,171,340 of Nishimura et al. In the former patent, an external heating source, e.g. an electric bulb provides sufficient heat to vaporize the sublimate solids, e.g. paradichlorobenzene, which may act as a fumigant. In the latter patent, water is added to a container so that it may contact an exothermic substance, which evolves heat upon contact by water, to decompose a blowing agent and to volatilize an active ingredient, such as an insecticide or fungacide. Again the substance is blown upward into the atmosphere, whence it falls by gravity.

The present invention has among its objects to increase positively the lateral dispersion of the aerosol particles and concomintantly to reduce the possibility of inadvertent dispersion of the fog on the user. These and other objects will become apparent as the invention is described in further detail.

Broadly, the invention relates to a method and system. A method for the total dispensing of the contents of a container, which comprises actuating a release valve by an actuator and placing at least said actuator in rotation about a vertical axis as the contents discharge. A preferred system for carrying out this method comprises an outer reservoir, an aerosol container within the reservoir, space between said reservoir and the aerosol container, suitable for addition of a fluid, preferably water, prior to actuation, a valve for release of said contents from said container and an actuator for opening the valve, the actuator having locking means for maintaining the valve in an open position and means for causing the container, the valve and the actuator to rotate as the contents of the container are discharged. The actuator comprises a central inlet for contacting the outlet valve stem of a valve on an aerosol container, at least one radially extending outlet in fluid communication with the inlet, means for opening the valve, locking means for locking the valve in an open position, the radially extending outlet having an orifice, through which the contents of the aerosol container, when the valve is open, will exit in a substantially horizontal plane and exert a sufficient force that the container and contents may rotate about a vertical axis of the container.

In greater detail, the invention relates to the total release of an aerosol with increased horizontal and downward spray application. To allow for total room perimeter coverage, the spray application must be continuous. In contradistinction to the aerosol foggers, which spray in an upward direction, we achieve our continuous application by rotating at least the actuator and preferably also the valve and aerosol container. A delay in rotation is incorporated into the device of the present invention in order to diminish the possibility that the user will be sprayed by the aerosol upon activation of the device hereof.

In a preferred embodiment, our invention relates to an aerosol with an orificed actuator, preferably a dual orificed actuator. The actuator and valve system are for total release actuation. The configuration and position of the actuator's internal metering are such that upon actuation, a propulsive force for container rotation is created.

Prior to actuation, the container is to be placed into a reservoir of water, so that the weight of the container causes the container to sink and come in contact with the bottom of the reservoir. When the actuator is locked into position for total release actuation, the propulsive force is insufficient to turn the container. As spray is released, the container progressively loses weight, to the point where the container approaches buoyancy. When the weight of the container has been sufficiently reduced, the propulsive force of actuation will exceed the friction or drag caused by the container in contact with the bottom of the reservoir. As a result, the container begins to rotate. As the container continues to lose weight, it becomes totally buoyant and the rate of rotation increases. Rotation will continue until the container has been completely evacuated.

Rotation of the container can be achieved by a single or multiorificed actuator and can be designed for an internal or external propulsion feature. Rotation can be achieved by free spinning in a water reservoir, an affixed or separate ball bearing unit, an affixed or separate spring wound rotating device, which would alleviate the need for a propulsive designed actuator, etc. The variations, not set in water, could be spring loaded to allow for delayed contact of the rotating feature, thus delaying container rotation. The container can either rotate upon actuation or have the rotation delayed depending on the level of water in the reservoir or by a variable setting on a spring loaded ball bearing unit or spring wound rotating device. Still further, the actuator, per se, may rotate to achieve the same results.

The invention will be further described with reference to the drawing wherein the same numeral in the various figures has identical meaning. In the drawing, which illustrates, our presently preferred system:

Figure 4:
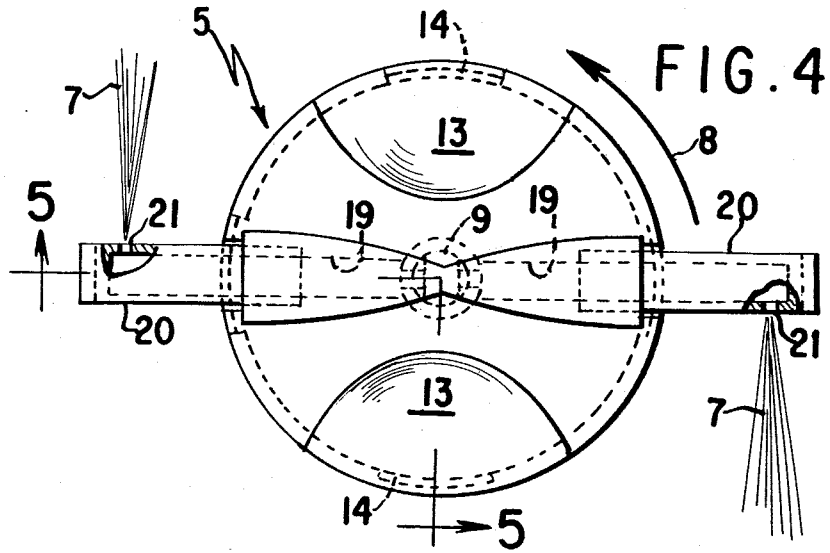
FIG. 4 shows a plan view of the actuator of FIG. 3.
Figure 6:
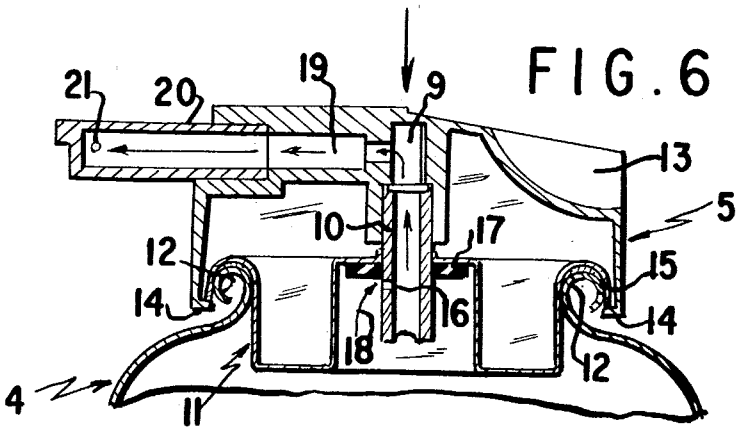
Figure 5:
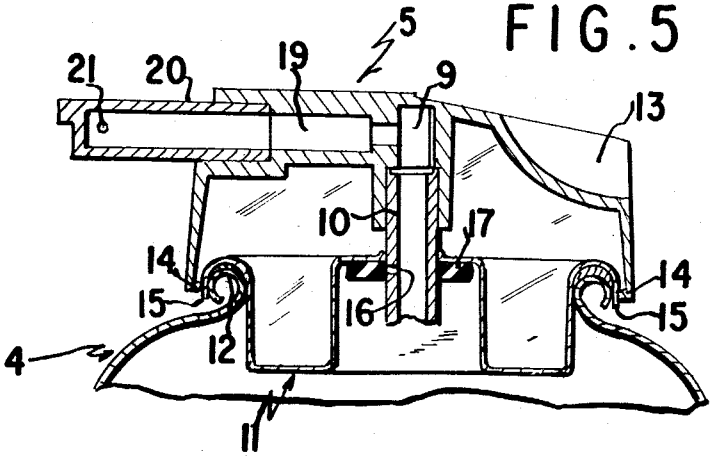
Figures 7, 8, 9, 10, 11, 12:
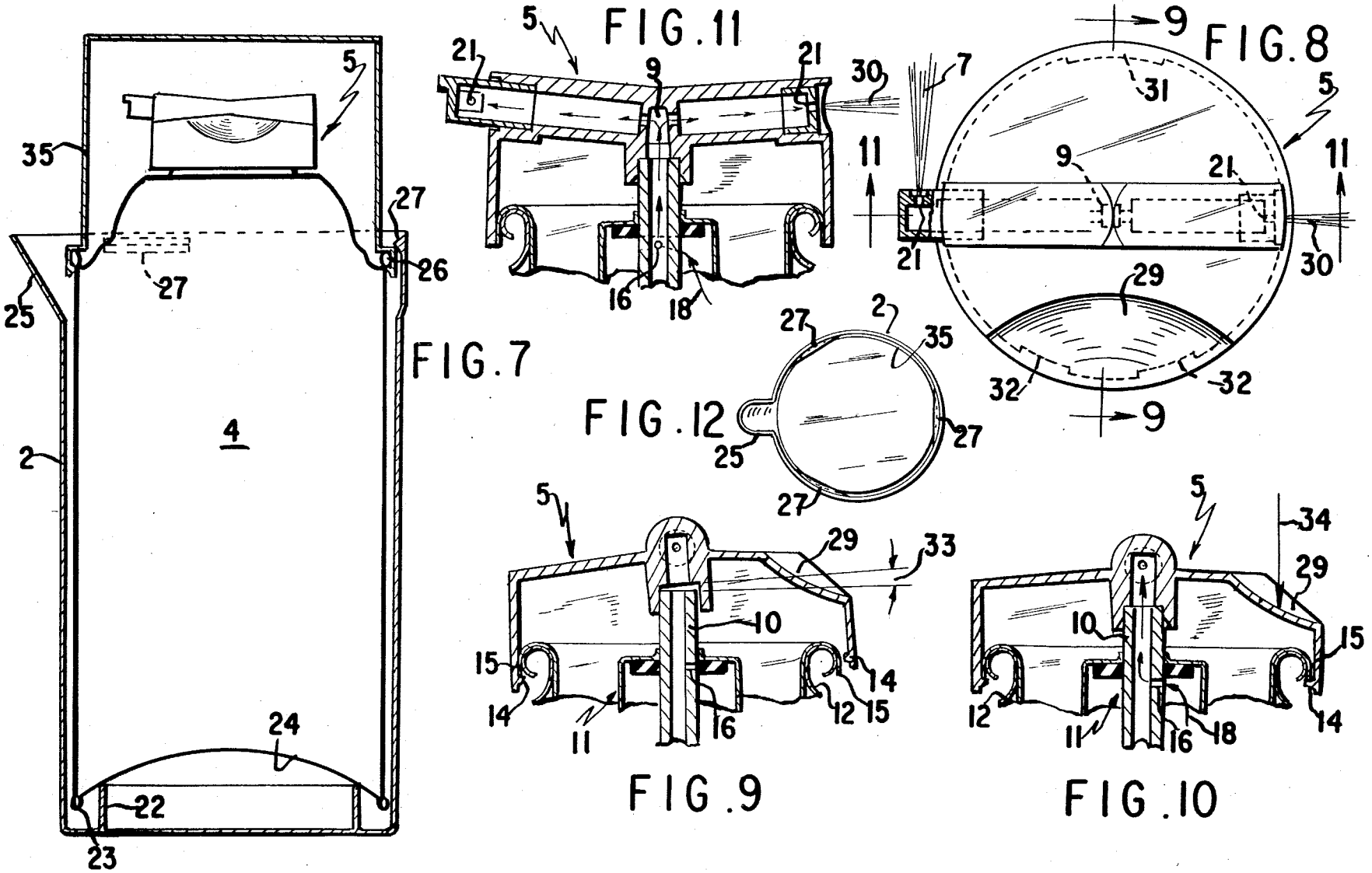

FIGS. 5 and 6 respectively show in unlocked and locked positions the actuator of FIG. 4, cut along 5—5, in place upon the curl of a can;

FIG. 7 shows a preferred spray release device within a canister prior to use;

FIG. 8 shows a plan view of the actuator of FIG. 7;

FIGS. 9 and 10 respectively show, in unlocked and locked positions, the actuator of FIG. 7, cut along 9—9 in place upon the curl of a can;

FIG. 11 shows in locked position, the actuator of FIG. 9, cut along 11—11;

FIG. 12 shows, in plan view, the canister of FIG. 7;

FIG. 13 shows a preferred detail of the interlocking of the canister and cap of FIG. 7;

FIG. 14 shows a preferred detail of the bottom of the canister of FIG. 7; and FIGS. 15 and 16 respectively show in schematic form a more preferred system prior to and in use.

Figure 1:
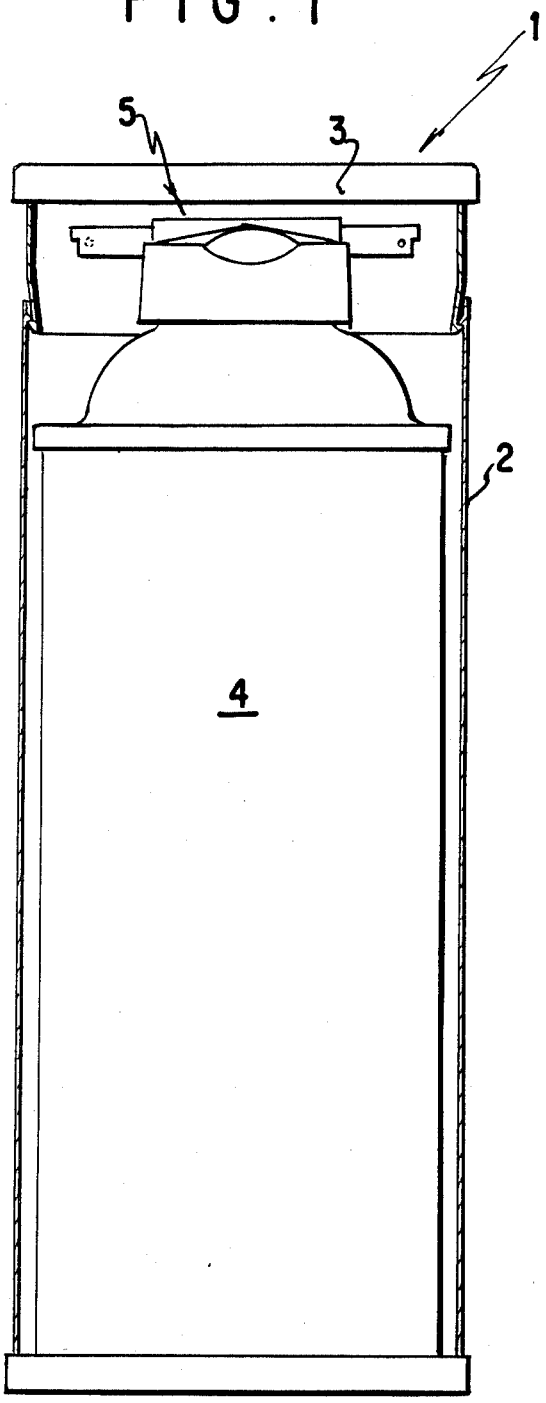
FIG. 1 shows a front view of spray release device within a canister prior to use.
Figure 2:
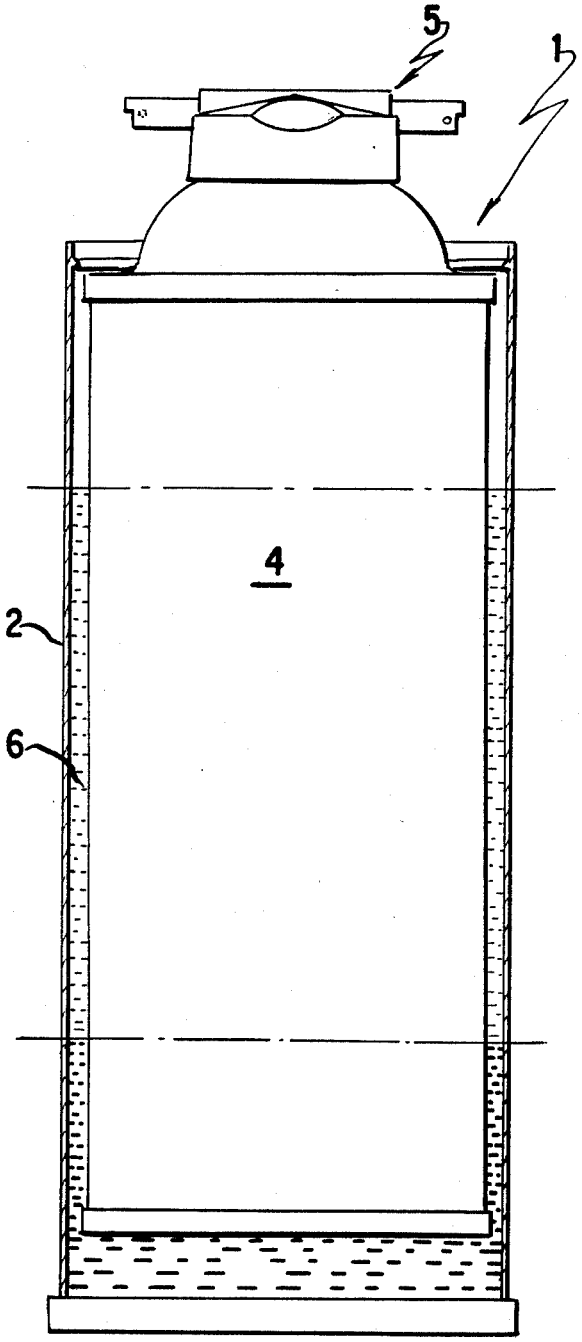
FIG. 2 shows a front view of the spray release device of FIG. 1, within the canister and with overcap removed in use.
Figure 3:
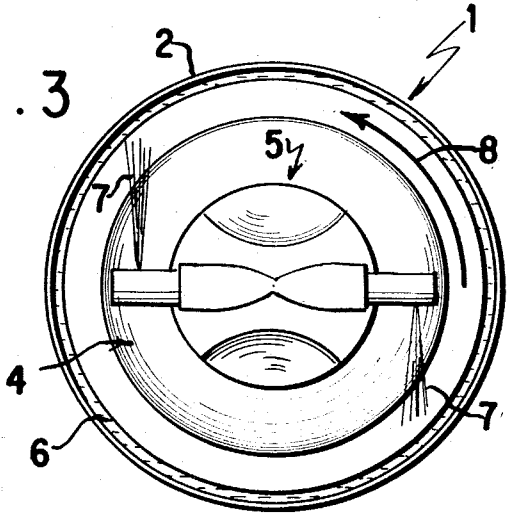
FIG. 3 shows schematically a plan of the device of FIG. 2.

Seen in FIGS. 1, 2, and 3 is the system 1 of the present invention comprising an outer canister 2, which also serves as a reservoir, covered by a canister cap 3. Situated in the canister is an aerosol container 4. In FIG. 2 the canister cap 3 has been removed, the reservoir has been filled with water 6, and the system is seen as in (FIG. 3) or after (FIG. 2) use. Additionally seen in FIG. 3 are twin tangential jets 7 of aerosol and a directional arrow 8 showing direction of rotation, of the aerosol container with actuator, caused by the exiting of the jet streams from the actuator.

Details of the actuator 5 are seen in FIGS. 4 to 6. FIGS. 4 and 6 show the actuator when in use, while FIG. 5 shows the actuator in an unlocked position prior to use. As is seen, the actuator 5 comprises a central inlet 9 for contacting a valve stem 10 of a valve 11 sitting on the curl 12 of aerosol container 4. The device is actuated by pressing downwardly on the detents 13 of actuator 5. This results in flanges 14 locking in place over the outer edge 15 of valve 11, and the central inlet 9 forcing the valve stem 10 downwardly so that the opening 16 therein is forced below valve stem gasket 17 of suitable material, whereby the contents may escape along the arrow path 18 from the aerosol container 4 through the valve stem 10 and the central inlet 9, through radially extending outlets 19 having inserts 20 with exit orifices 21 therein. As the aerosol jets 7 exit from the orifices, they cause a torque to form against the back of the inserts which in turn, causes the entire actuator to rotate as seen by directional arrow 8.

FIGS. 7 through 14 show some preferred variations of the device of FIGS. 1 through 6. In FIG. 7, the outer canister 2 has a water dam 22, which in conjunction of the bottom chime and bottom 24 of aerosol container 4 form an air bubble under the bottom 24 when water is placed into the outer canister 2, which as stated hereinabove, serves as a reservoir. This is simplified by the inclusion of water catcher or spout 25 in the outer canister. An even more preferred embodiment of the lower portion of the outer canister showing the water dam, the chime and the bottom of the aerosol container is seen in FIG. 14. Also seen in FIG. 7, near the upper portion of canister 2, are the upper chime of the canister over which the overcap locks and which is also locked into canister 2 via ridges 27. The relationship of these ridges to canister 2 and water catcher 25 is more clearly seen in FIG. 12. FIG. 13 shows a preferred variation wherein overcap 35 is inserted into outer canister 2, the upper edge of which has an outward flare 28. The overcap 35 is locked into the outer canister 2 by a press fit. The locking means of FIG. 13 is preferred over that of FIG. 7 in that this locking means ensures that the upper chime 26 of the aerosol container 4 clears the ridges 27 as the aerosol container begins to float.

FIG. 9 is similar to FIG. 4 but differs therefrom in that there is a single detent 29 instead of the dual detents of FIG. 4. As a result thereof, the user will only depress this single detent, holding the system away from themself whereby the aerosol jets 7 and 30 will be directed away from the user thereby reducing tbe likelihood of the inadvertent spraying of the user. Single bayonet lock 31 and dual locks 32 are used to lock the actuator 5 in place. This is more clearly seen in FIGS. 9 and 10 wherein the bayonet lock, which consists of the flange 14, is over the outer edge 15 of valve 11 and the single detent is not yet depressed. The actuator is tilted a few degrees, from the horizontal, as is shown by angle 33, because one side of the actuator is locked into position and the opposite side is unlocked. When pressure is applied in the direction of pressure arrow 34, the actuator 5 assumes a horizontal position and pushes down on the valve stem 10 of the vertically operating valve 11 so that opening 16 is exposed whereby the aerosol may exit along arrow path 18. This exiting of the aerosol is more clearly seen in FIG. 11.

FIGS. 15 and 16 show the presently preferred system. In this system, which uses the same actuator 5 as used in the other Figures, the aerosol container with the overcap 35 is placed in outer canister 2 and covered by canister cap 3. To use, as is seen in FIG. 16, the cap is removed, filled with water, which is emptied into outer canister 2 to provide the proper amount of water. The overcap is placed on the bottom of the aerosol container and entraps air between it and the bottom of aerosol container. The air increases the buoyancy of the aerosol container and permits rotation of the container, actuator and contents. As another alternative, a flat cap can be on the bottom of aerosol container. This would entrap air between the flat cap and the aerosol container. Both of these alternatives preclude escape of the air bubble.

Although downwardly operating valves have been shown, tilt action valves can also be utilized. Still further, instead of water being used as a fluid in which the aerosol container is situated, other fluids could also be used. Even further an entirely dry system could be used by placing the entire canister on a small turntable, which may or may not be delayed actuated. It should be noted that the significant advantage of the present system over the fogger systems previously used is that the spray will be forced in a horizontal plane without reaching the upper portions of the volume sprayed. This if one is using an insecticide for instance, in a kitchen, the insecticide will not cover the upper kitcher cabinets, in which dishes are stored and would obviate the necessity of having to reclean these dishes. If on the other hand, it is desired that the spray fill the entire volume, e.g. it is possible to have a third orifice, or have a second orifice, upwardly directed whereby the entire room may be sprayed. It is of course necessary for the invention to work whereby the pressure of the escaping aerosol causes rotation that the horizontal vector of the escaping aerosol be sufficient that rotation ensues. On the other hand, where a mechanically or electrically operated turntable is utilized, both aerosol jets 30 may exit axially from the central inlet 9.

Having described this invention with reference to a preferred device and equivalents thereof,

We claim:

1. A method for dispensing the contents of a container, which comprises placing a product containing aerosol container, having a product release valve and an actuator thereon, and fluid into an outer reservoir, opening said product release valve by placing said actuator into a locked position to cause said container, said product release valve, and said actuator to rotate about a vertical axis of said reservoir as the product discharges from said product containing aerosol container.

2. The method of claim 1, wherein the container and fluid are placed sequentially into the outer reservoir.

3. The method of claim 1, wherein insecticide is dispensed.

4. A system for the total dispensing of the contents of a container, which comprises an outer reservoir, an aerosol container within said reservoir, space between said reservoir and said aerosol container, suitable for addition of a fluid prior to actuation, a valve for release of said contents from said container and an actuator for opening said valve, said actuator having locking means for maintaining said valve in an open position and means for causing said container, said valve and said actuator to rotate coaxially about a vertical axis of said reservoir as the contents of said container are discharged.

5. A dispensing system which comprises an aerosol container, a reservoir surrounding said aerosol container and an actuator for operating a valve having an outlet valve stem on said container, said actuator comprising a central inlet for contacting said outlet valve stem of said valve on said aerosol container, at least one radially extending outlet in fluid communication with said inlet, means for opening said valve, locking means for locking said valve in an open position, said radially extending outlet having an orifice through which the contents of said aerosol container, when said valve is open, will exit in a substantially horizontal plane and exert a sufficient force that said container and contents may rotate solely about a vertical axis of said container and said reservoir.

* * * * *